US010543433B1

(12) United States Patent
Hermanson et al.

(10) Patent No.: US 10,543,433 B1
(45) Date of Patent: Jan. 28, 2020

(54) MOVEABLE FIGURINE ASSEMBLY

(71) Applicant: MR. CHRISTMAS INCORPORATED, New York, NY (US)

(72) Inventors: Terry Hermanson, New York, NY (US); Haung Meng-Suen, Hong Kong (CN)

(73) Assignee: MR. CHIRSTMAS INCORPORATED, New York, NY (US)

( * ) Notice: Subject to any disclaimer, the term of this patent is extended or adjusted under 35 U.S.C. 154(b) by 0 days.

(21) Appl. No.: 16/003,259

(22) Filed: Jun. 8, 2018

(51) Int. Cl.

| | |
|---|---|
| ***G09F 19/00*** | (2006.01) |
| ***A63H 11/14*** | (2006.01) |
| ***A63H 13/20*** | (2006.01) |
| ***A63H 13/12*** | (2006.01) |
| ***A63H 29/22*** | (2006.01) |
| ***G09F 19/08*** | (2006.01) |

(52) U.S. Cl.
CPC ..... *A63H 13/12* (2013.01); *A63H 11/14* (2013.01); *A63H 29/22* (2013.01); *G09F 19/08* (2013.01)

(58) Field of Classification Search
CPC ..... A63H 7/04; A63H 11/14; A63H 13/00; A63H 13/20; G09F 19/08
USPC ..... 446/273, 274; 40/430; 472/6, 10
See application file for complete search history.

(56) References Cited

U.S. PATENT DOCUMENTS

| | | | | | |
|---|---|---|---|---|---|
| 70,850 | A * | 11/1867 | Humans | A63H 7/04 | 446/274 |
| 849,280 | A * | 4/1907 | Stevens | A63H 7/04 | 446/273 |
| 1,000,219 | A * | 8/1911 | West | A63H 13/20 | 472/6 |
| 2,349,492 | A * | 5/1944 | Eakin | A63H 13/00 | 446/274 |
| 2,858,643 | A * | 11/1958 | Stanley | A63H 11/14 | 446/274 |
| 3,108,397 | A * | 10/1963 | Shanks | A63H 11/14 | 446/274 |
| 3,111,781 | A * | 11/1963 | Frois | A63H 11/14 | 40/415 |
| 5,632,107 | A * | 5/1997 | Meng-Suen | G09F 19/08 | 40/430 |

* cited by examiner

*Primary Examiner* — Alexander R Niconovich
(74) *Attorney, Agent, or Firm* — Venable LLP

(57) ABSTRACT

A moveable figurine assembly including a base, a moveable support supported by the base, a figurine balanced on the moveable support, and a movement mechanism. The figurine includes a wheel, a body and a pair of extensions. The body of the figurine is positioned above the wheel and connected to the wheel, and each extension of the pair of extensions has a first end attached to the body and a second end. The movement mechanism is configured to move the support such that at least a portion of the support is inclined at an angle relative to horizontal, and when the direction is inclined at a downward angle, the figurine moves on the support in a downward direction.

20 Claims, 8 Drawing Sheets

MOVEABLE FIGURINE ASSEMBLY

FIELD OF THE INVENTION

This invention generally relates to mechanical decorations. More particularly, this invention relates to a moveable figurine.

BACKGROUND OF THE INVENTION

Novelty items, such as mechanical decorations, are popular for decorating homes, office spaces, and the like. These novelty items are particularly popular when decorating for holidays and may include figurines corresponding to the holiday. For example, when decorating for Christmas, novelty items, including mechanical decorations, may be displayed that include figurines of Santa Clause. Such novity items, however, are not limited to holidays and may also be directed to other decorations, including those that correspond to one's interests, such as sports teams, movies, music, etc. This invention is directed to one such novelty item that includes a main body, such as a figurine, that is moveable.

SUMMARY OF THE INVENTION

In one aspect, the invention relates to a moveable figurine assembly including a base, a moveable support supported by the base, a figurine balanced on the moveable support, and a movement mechanism. The figurine includes a wheel, a body and a pair of extensions. The body of the figurine is positioned above the wheel and connected to the wheel, and each extension of the pair of extensions has a first end attached to the body and a second end. The movement mechanism is configured to move the support such that at least a portion of the support is inclined at an angle relative to horizontal, and when the direction is inclined at a downward angle, the figurine moves on the support in a downward direction.

In another aspect the invention relates to a moveable figurine assembly including a base, a pair of moveable supports including a first support and a second support, a cord, a figurine, and a movement mechanism. Each of the supports extends upward from the base, such that the second support is spaced apart from the first support in a first direction. The cord (i) is attached to each of the first and second supports at an attachment point and (ii) spans a distance between the first support and the second support. The figurine is balanced on the cord and includes a wheel, a body, and a pair of extensions. The wheel has an outer circumference with a groove therein. A bottom portion of the wheel contacts the cord, and a portion of the cord is within the groove. The body of the figurine is positioned above the wheel and connected to the wheel. One extension of the pair of extensions is located on one side of the wheel relative to a plane in which the first direction lies, and the other extension of the pair of extensions is located on the other side of the wheel relative to the plane in which the first direction lies. Each extension of the pair of extensions has a mass located thereon. The movement mechanism is configured to move the first and second supports to incline the first direction relative to horizontal such that the figurine (i) moves in the first direction when the first direction is inclined at a downward angle and (ii) moves in a direction opposite to the first direction when the first direction is inclined at an upward angle.

In a further aspect, the invention relates to a moveable main body assembly including a first support, a second support, a transverse support, a wheel, a main body, and a pair of extensions. The second support is spaced apart from the first support in a first direction, and the second support is moveable. The transverse support (i) is attached to each of the first and second supports at an attachment point and (ii) spans the distance between the first support and the second support. A bottom portion of the wheel contacts the transverse support. The main body is connected to the wheel and is configured to change positions on the transverse support when the second support is moved, such that the main body (i) moves in the first direction when the attachment point of the transverse support to the second support is lowered and (ii) moves in a direction opposite to the first direction when the attachment point of the transverse support to the second support is raised. One extension of the pair of extensions is located on one side of the wheel relative to a plane in which the first direction lies and the other extension of the pair of extensions being located on the other side of the wheel relative to the plane in which the first direction lies. Each extension of the pair of extensions having a mass located thereon.

These and other aspects, objects, features, and advantages of the invention will become apparent from the following detailed description of illustrative embodiments thereof, which is to be read in connection with the accompanying drawings.

BRIEF DESCRIPTION OF THE DRAWINGS

FIG. 7A shows the moveable figurine assembly in an initial position. FIG. 7B shows the moveable figurine assembly as supports of the moveable figurine assembly begin to move. FIGS. 7C and 7D show the moveable figurine assembly with the figurine at two different positions, respectively. FIG. 7E shows the moveable figurine assembly with the figurine and supports at the end of their travel. FIG. 7F shows the moveable figurine assembly as supports of the moveable figurine assembly begin to move in a direction opposite the direction of movement in FIG. 7B. FIGS. 7G and 7H show the moveable figurine assembly with the figurine at two different positions, respectively. FIG. 7I shows the moveable figurine assembly with the figurine and supports at the end of their travel, which is the same as the initial position shown in FIG. 7A.

DETAILED DESCRIPTION OF THE PREFERRED EMBODIMENTS

Figure 1:
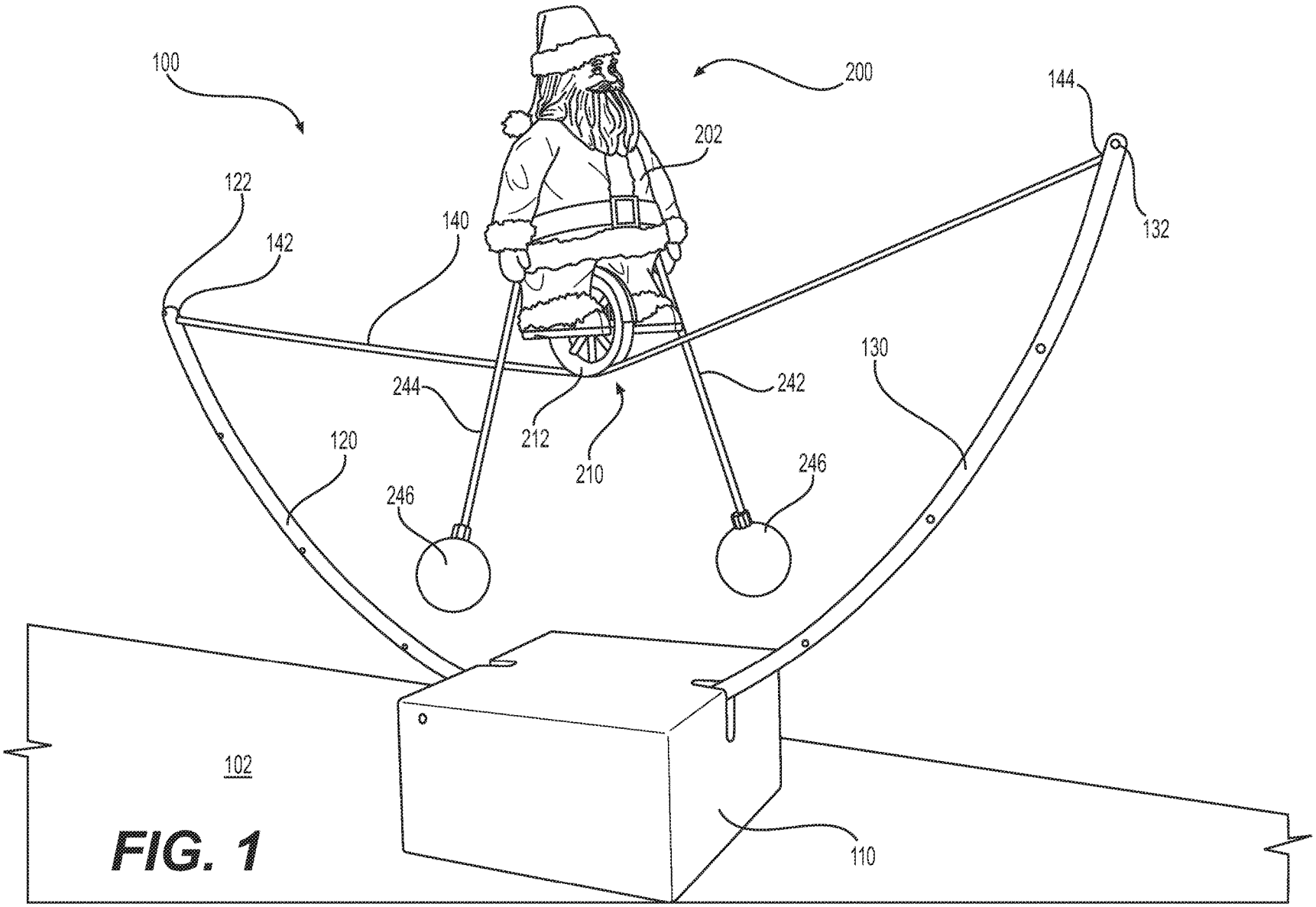
FIG. 1 shows a moveable figurine assembly according to a preferred embodiment of the invention.
Figure 2:
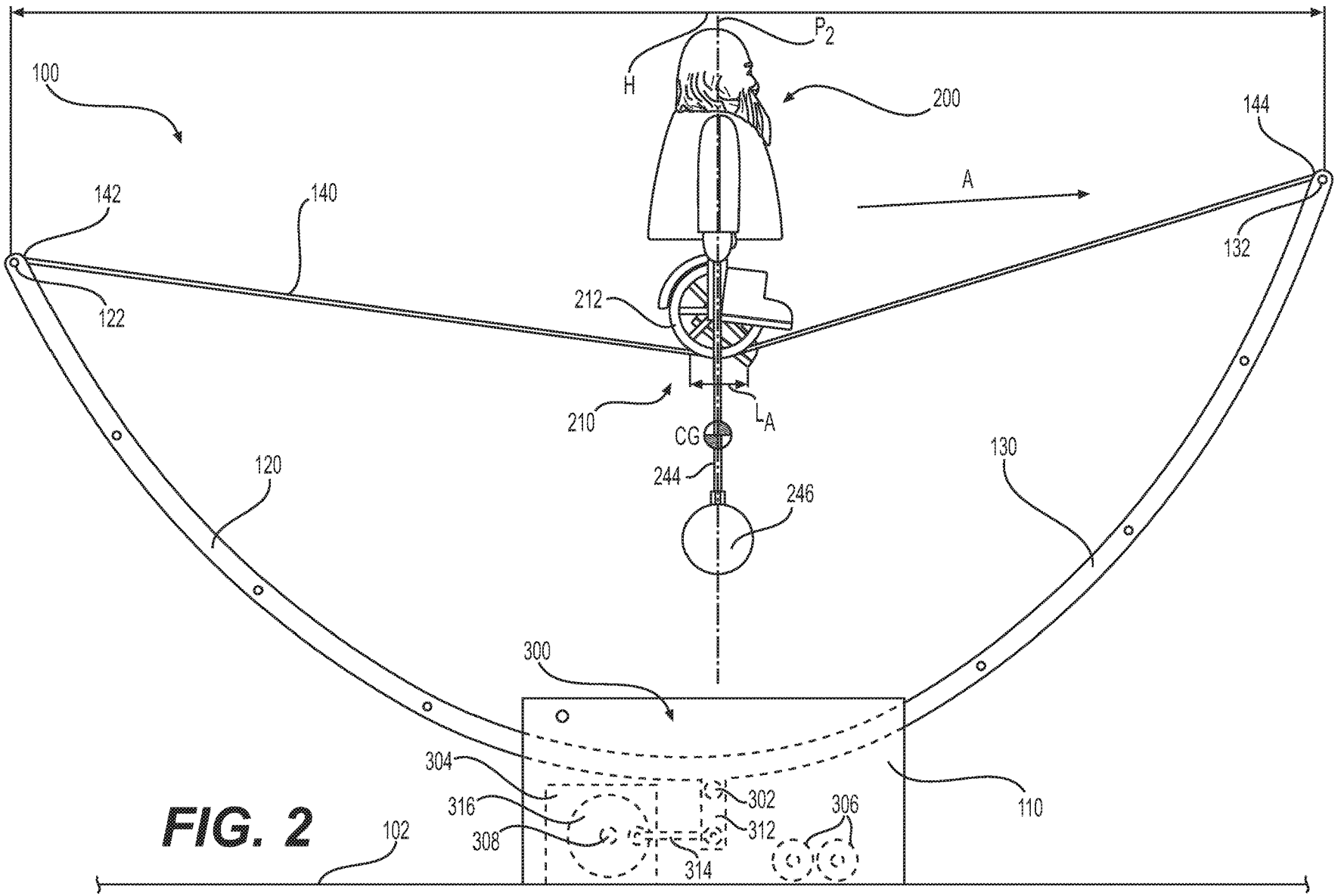
FIG. 2 is a side view of the moveable figurine assembly shown in FIG. 1.

FIG. 1 is a perspective view of a moveable figurine assembly 100 according to a preferred embodiment of the invention. FIG. 2 is a side view of the moveable figurine assembly 100. The moveable figurine assembly 100 includes a base 110 which is used to support, via a pair of supports 120, 130 and a cord 140, a moveable figurine 200 balanced on the cord 140. In this embodiment, the base 110 is configured to sit on a horizontal surface 102 such as a table or mantel, for example.

Extending upward from the base 110 is the pair of supports. The pair of supports include a first support 120 and a second support 130. Although the first support 120 and second support 130 may be separately formed, in this embodiment, the first and second supports 120, 130 are integrally formed from a rod. Also in this embodiment, the first and second supports 120, 130, together, have an arcuate shape (see FIG. 2). The first and second supports 120, 130, whether integrally or separately formed, may have any suitable shape, instead of being arcuate, and have any suitable geometry, instead of a rod. The first support 120 extends upward and away from the base 110 to an end 122 of the first support 120, and the second support 130 also extends upward and away from the base 110 to an end 132 of the second support 130. The first and second supports 120, 130 extend away from the base 110 in directions opposite to each other, and thus the end 122 of the first support 120 is spaced apart from the end 132 of the second support 130 in a direction A by a distance H.

The cord 140 is attached to the first support 120 at an attachment point 142, and attached to the second support 130 at an attachment point 144. The cord 140 thus spans the distance H between the ends 122, 132 of the first and second supports 120, 130. Herein the first support 120, the second support 130, and the cord 140 are discussed separately for convenience to describe the various features of each in the preferred embodiment. The first support 120, the second support 130, and the cord 140 may, however, be considered, collectively, a support, and the cord 140 may be referred to herein as a transverse portion of the support or a transverse support. Although the transverse support (or transverse portion) is shown as a cord in the preferred embodiment, the transverse support is not so limited. Any suitable transverse support for supporting the figurine 200 may be used, including, for example, a rail, a rod, or a beam.

As illustrated, in a preferred embodiment a length of the cord is slightly longer than the distance H between the ends of 122, 132 of the first and second supports 120, 130, thus allowing for a small amount of slack. Metal wire, plastic cord, and string are all suitable materials for the cord. Alternatively, a taut cord could be used, made of the same materials, for example. The attachment point 142 on the first support 120 is proximate the end 122 of the first support 120, and, likewise, attachment point 144 on the second support 130 is proximate the end 132 of the second support 130. As will be discussed further below, the attachment points 142, 144 are spaced a distance lower than the corresponding end 122, 132 so that the first and second supports 120, 130 also provide a stop for the figurine 200.

Figure 3:
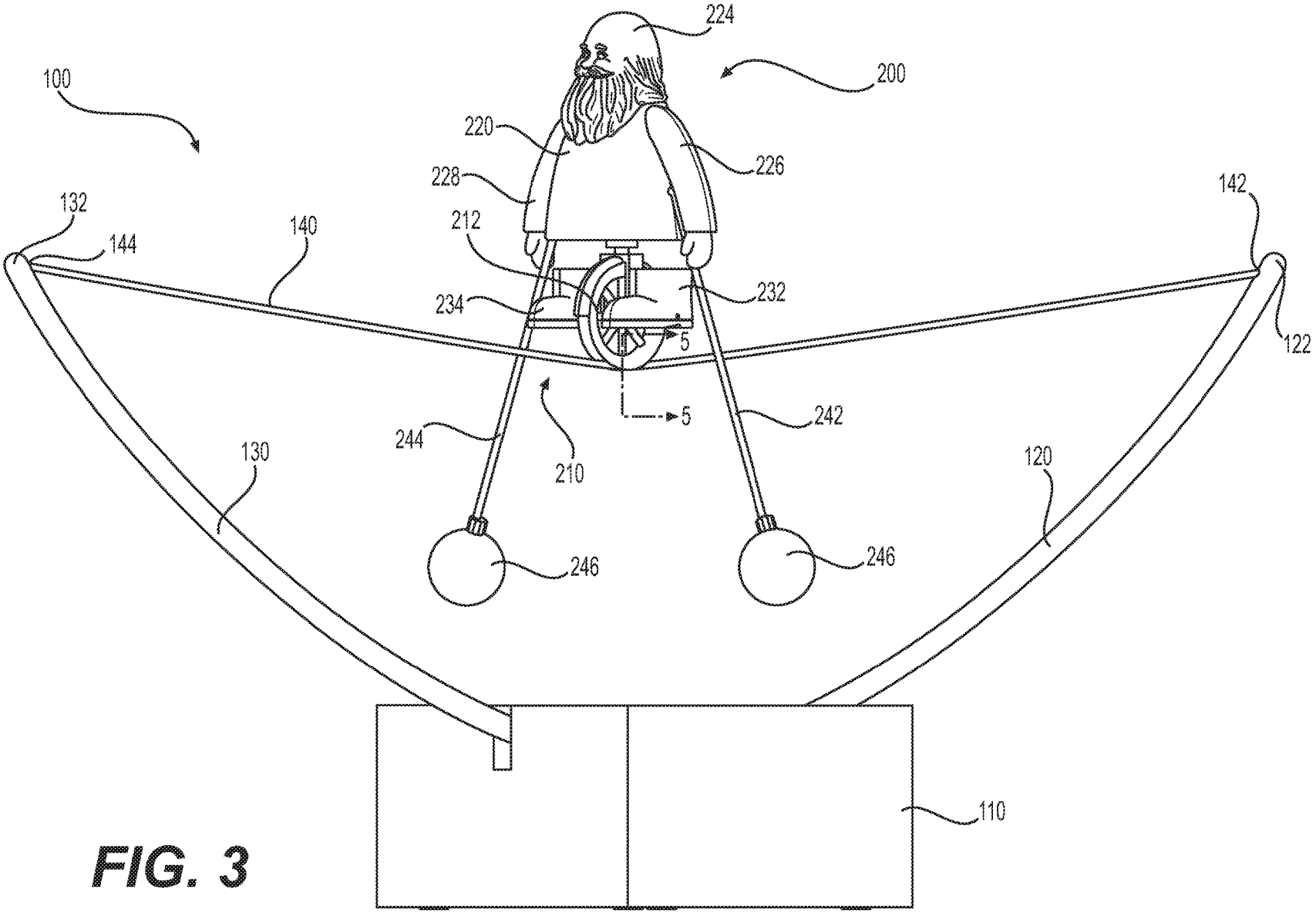
FIG. 3 is another perspective view the moveable figurine assembly shown in FIG. 1 with outer coverings of a figurine removed to show the underlying structure of the figurine.
Figure 4:
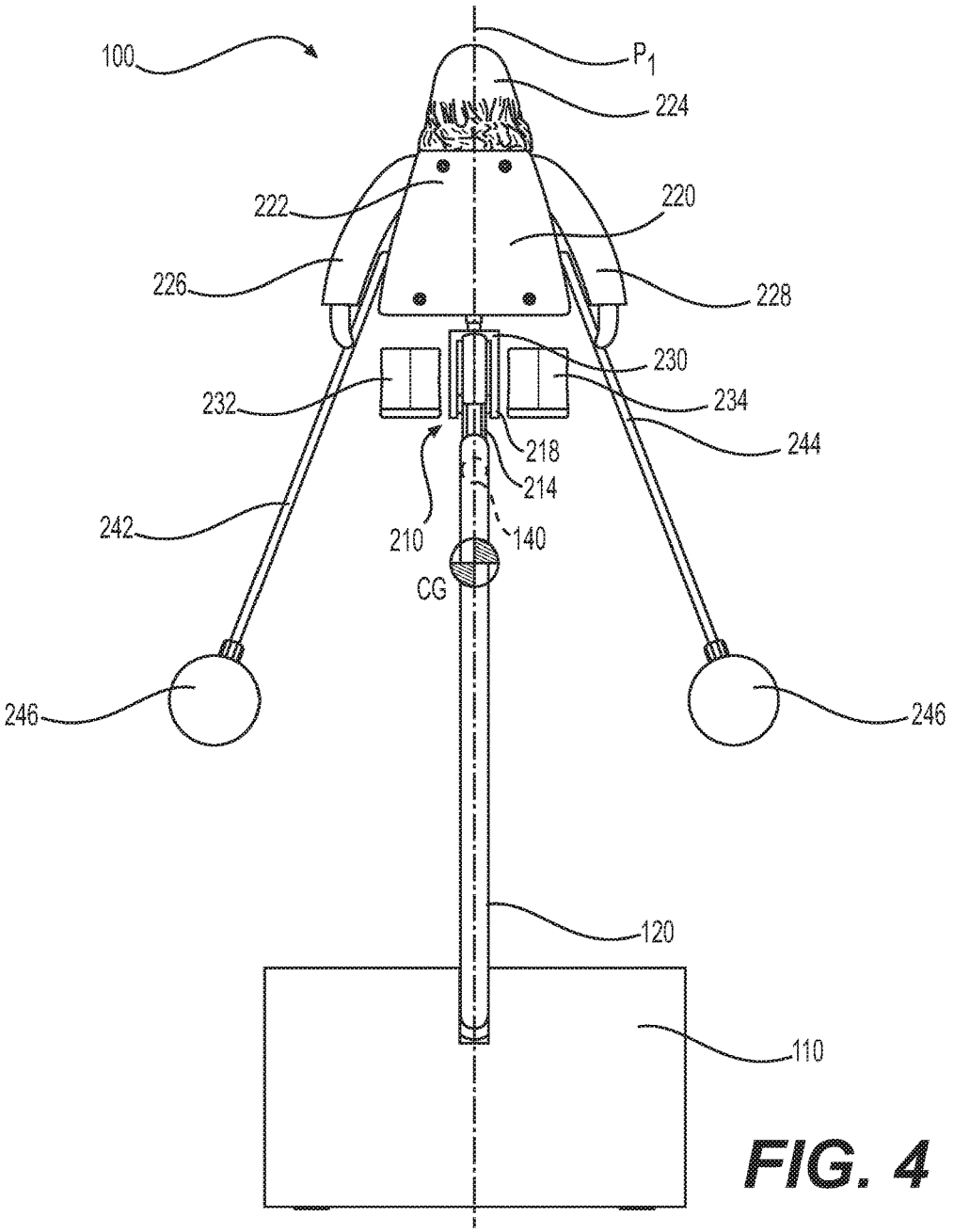
FIG. 4 is end view of the moveable figurine assembly shown in FIG. 3.

The figurine 200 is balanced on the cord 140 and moveable on the cord 140. In this embodiment, the figurine 200 includes a fabric covering 202 (outer covering), which may take the form of clothes for the figurine 200. For example, the figurine 200 of this embodiment is a Santa Claus, and the fabric covering 202 is used to depict a Santa suit. In FIGS. 3 and 4, the fabric covering 202 has been removed to show the underlying structure of the figurine 200. FIG. 3 is a perspective view of the moveable figurine assembly 100, and FIG. 4 is an end view of the moveable figurine assembly 100.

Figure 5:
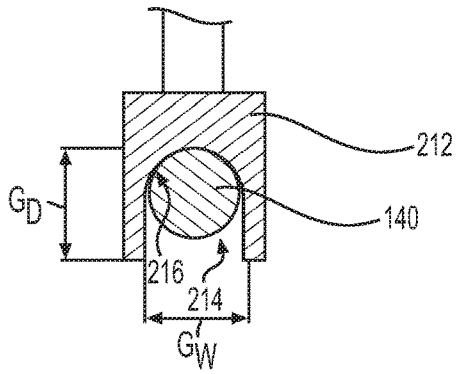
FIG. 5 is a cross-section view of the wheel taken along line 5-5 in FIG. 3.

The figurine 200 includes a wheel 210, which is in contact with the cord 140 and used to support the figurine 200 on the cord 140. The wheel 210 has an outer circumference 212 with a groove 214 formed therein. FIG. 5 shows the groove 212 and cord 140 in more detail. FIG. 5 is a cross-section view of the wheel taken along line 5-5 in FIG. 3. The groove 214 has a width $G_W$ that is slightly wider than the diameter of the cord 140, allowing the cord 140 to fit inside the groove 214. The groove 214 also has an arched surface 216 that contacts the cord 140. This arched surface 216 is preferably arched with a radius that corresponds to the radius of the cord 140 to provide a stable contact surface between the cord 140 and the wheel 210. The groove 214 also has a depth $G_D$ that is preferably greater than the diameter of the cord 140, helping the wheel 210 remain securely on the cord 140.

When the figurine 200 is placed on the cord 140, the cord 140 angles downward, due to its slack, from each of its attachment points 142, 144 to the bottom portion of the wheel 210 where the wheel contacts the cord 140 (see FIG. 2). As a result, the cord 140 is in contact with the wheel over an arc length $L_A$ of the outer circumference 212 of the wheel 210. Other suitable means may be used to create the downward angles of the cord 140, including, for example, elastic deformation of either the cord 140 or the pair of supports 120, 130 when the figurine 200 is placed on the cord 140.

As shown in FIG. 4, the wheel 210 includes a shaft 218 about which it rotates (rotation axis), and the wheel 210 rotates on the cord 140 to allow the figurine 200 to move back and forth on the cord 140, as described further below. The figurine 200 includes a main body 220 which is connected to the wheel 210 by a frame 230. The frame 230 is forked, and each end of the shaft 218 is rotatably connected to one of the forks of the frame 230. In this embodiment, the main body 220 is designed to resemble a human and includes a torso 222, a head 224 connected to the torso, and a pair of arms, a left arm 226 and a right arm 228. The torso 222 is positioned above the wheel 210 and connected to the wheel 210 by the frame 230. Each arm 226, 228 of the pair of arms extends outward in an axial direction of the wheel 210 (a longitudinal direction of the shaft 218) and downward from the torso 222.

The figurine 200 also includes two feet, a left foot 232 and a right foot 234. In this embodiment, each foot 232, 234 is in the shape a boot. Each foot 232, 234 in this embodiment is connected to the wheel 210 at a position between the shaft 218 and the outer circumference 212 of the wheel 210. Both feet 232, 234 are connected along a line that passes through the shaft 218, located on opposite sides of the shaft 218, giving the illusion of the figurine 200 pedaling as the wheel 210 rotates. The fabric covering 202 may have pants, which connect the feet 232, 234 to the main body 220. With this construction, the figurine 200 does not include an underlying structure (e.g., legs) connecting the feet 232, 234 to the main body.

As discussed above, the figurine 200 is balanced on the cord 140. The figurine 200 preferably thus has its weight evenly distributed between its left and right sides. Put another way, the weight of the figurine 200 is preferably distributed such that the center of gravity CG of the figurine 200 is located in a plane $P_1$ in which the cord 140 lies (see FIG. 4). In this embodiment, the main body 220 is symmetrical about plane $P_1$. To be balanced on the cord 140, the center of gravity CG is preferably low on the figurine 200, more preferably at the level of the cord 140, and most preferably lower than the cord 140. The main body of the figurine 200, in particular the torso 222 and head 224, has a generally triangular shape thus lowering the center of gravity CG of the figurine 200.

The figurine 200 further includes a pair of extensions, a left extension 242 and a right extension 244. Each extension 242, 244 extends outward from the main body 220, thus increasing the rotational inertia of the figurine 200 and decreasing its tendency to roll over to one side. Each extension 242, 244 includes a mass 246, and in this embodiment, the mass 246 is located on the end of its corresponding extension 242, 244. Preferably, the mass 246 of each extension 242, 244 is located below the cord 140 to further lower the center of gravity CG of the figurine 200 and locate the center of gravity CG below the level of the cord 140, as shown in FIG. 4. Each extension 242, 244 thus preferably extends, not only outward from the main body 220, but also downward, locating each mass 246 below the cord 140. To locate the center of gravity CG below the level of the cord 140, the mass of the figurine 200 located above the cord 140 is preferably minimized, while the mass 246 on each of the extensions 242, 244 is maximized, thus lowering the center of gravity CG to better balance the figurine 200 on the cord 140. As with the main body 220 of the figurine 200, the extensions 242, 244 are preferably symmetrical about plane $P_1$ locating the center of gravity of the figurine 200 in the plane $P_1$.

The extensions 242, 244 of this embodiment are designed to create the illusion that the figurine 200 is holding onto the extension with its hands. Thus, the end of the left extension 242 opposite the mass 246 is located proximate the left arm 226, and the end of the right extension 244 opposite the mass 246 is located proximate the right arm 228. Although shown as separate pieces, the extensions 242, 244 may be integrally formed and may have any suitable geometry, including that of a rod as shown in the FIGS. 1-4.

Not only is the weight of the figurine 200 distributed evenly about plane P1 to locate the center of gravity CG in $P_1$, the weight of the figurine 200 is also preferably evenly distributed forward and back about a plane $P_2$ (see FIG. 2) in which the shaft 218 (axis of rotation of the wheel 210) lies. Thus not only is the figurine 200 balanced on the cord 140 such that figurine 200 does not tip over to one side, but is also balanced such that the figurine 200 does not fall over and onto the cord 140 in either a forward or back direction.

As discussed above, the figurine 200 is moveable on the cord 140 by the wheel 210. Gravity is used to move the figurine 200 in a forward and backward direction on the cord 140. The forward direction is direction A and the backward direction is the direction opposite direction A. To move the figurine 200, the cord 140 is inclined relative to horizontal as will be discussed further below with reference to FIGS. 7A-7I. In this embodiment the cord 140 is inclined by moving the first and second supports 120, 130 with a movement mechanism 300. As shown in FIG. 2, the movement mechanism 300 is located in the base 110 in this embodiment. The first and second supports 120, 130 are oscillated about a pivot 302 by an electric motor 304. In this embodiment, the motor 304 is powered by batteries 306 housed in the base 110. A battery cover (not shown) may be used to allow the replacement of the batteries 306. The motor 304 may be powered by other sources including, for example, an electrical outlet or solar energy. Instead of a motor 304 other suitable drive mechanisms may be used, including for example, a mechanical winding mechanism.

Figure 6A:
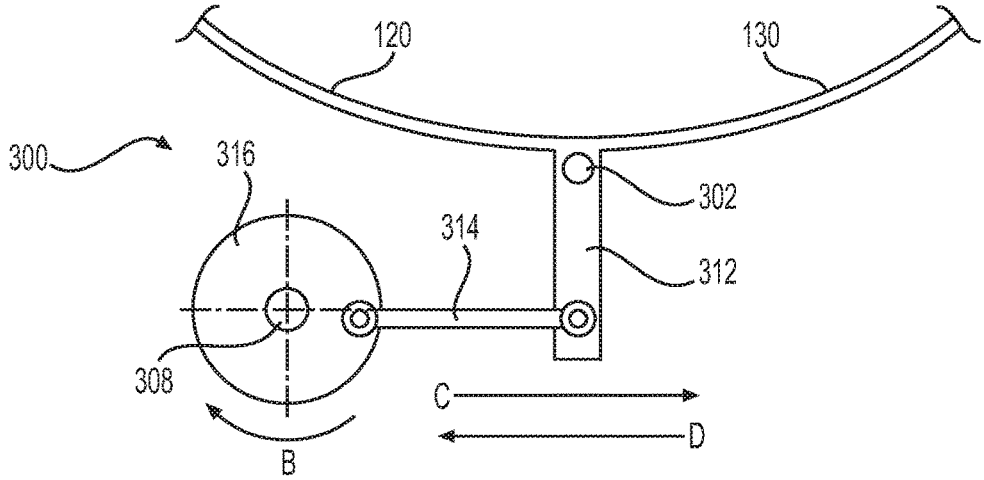
FIG. 6A shows a movement mechanism that may be used to move the supports of the moveable figurine assembly shown in FIG. 1.

The electric motor 304 may be connected and configured to oscillate the first and second supports 120, 130 about the pivot 302 by any suitable mechanism. The movement mechanism 300 shown in FIGS. 2 and 6A uses a driving crank. The pivot 302 is located in a linkage 312 connected to the center of the arcuate first and second supports 120, 130. In this embodiment, the linkage is a linear linkage extending downward from the center of the arcuate first and second supports 120, 130. A connecting rod 314 is attached to an end of the linkage 312 with a pivotable connection. The connecting rod 314 is also attached with a pivotable connection to an outer portion of a wheel 316. The wheel 316 is rotated by a shaft 308 of the motor 304. When the wheel 316 is rotated in direction B, the connecting rod 314 moves back and forth in directions C and D, and as a result, moves the end of the linkage 312 to which the connecting rod 314 is attached in directions C and D. When the linkage 312 is moved in direction C, the second support 130 rotates about the pivot 302 in direction E (see FIGS. 7B-7D), and the first support 120 rotates about the pivot 302 in direction F (see FIGS. 7B-7D). When the linkage 312 is moved in direction D, the first support 120 rotates about the pivot 302 in direction G (see FIGS. 7F-7H), and the second support 130 rotates about the pivot 302 in direction H (see FIGS. 7F-7H).

Figure 6B:
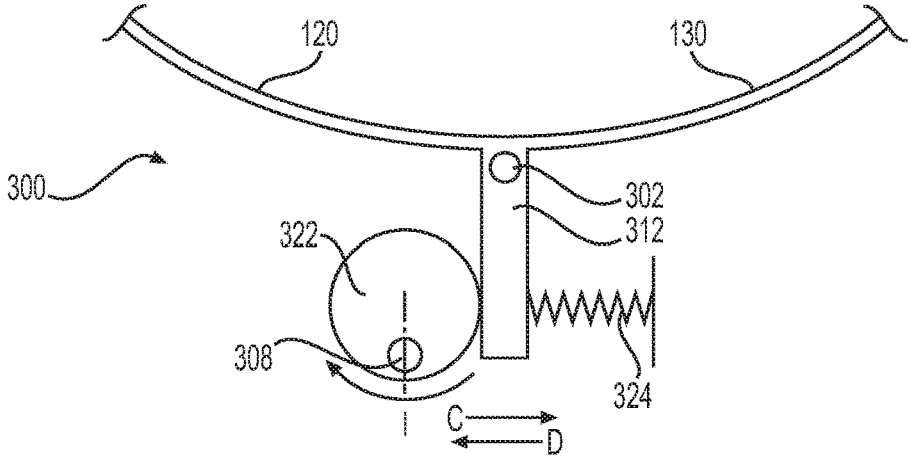
FIG. 6B shows another movement mechanism that may be used to move the supports of the moveable figurine assembly shown in FIG. 1.

FIG. 6B shows another suitable movement mechanism 300. In this embodiment, the movement mechanism 300 uses a driving cam 322. A spring 324 is used to press the linkage 312 against the outer surface of the cam 322. The shaft 308 of the motor 304 is used to rotate the cam 322 in direction I. Because the shaft 308 of the motor 304 is offset from the center of the cam 322, the linkage 312 moves in directions C and D as the cam 322 is rotated in direction I.

Figure 6C:
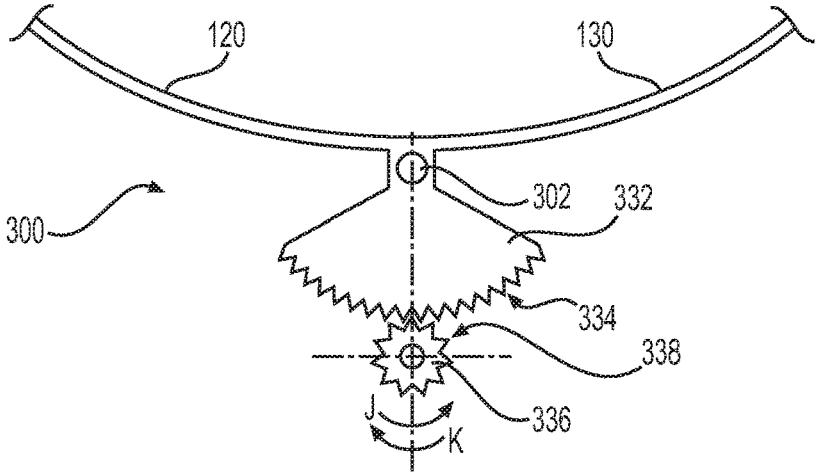
FIG. 6C shows a further movement mechanism that may be used to move the supports of the moveable figurine assembly shown in FIG. 1.

FIG. 6C shows yet another suitable movement mechanism 300. In this embodiment, the movement mechanism 300 is a direct gear drive. Instead of a linear linkage 312, a circular arc portion 332 is formed below the pivot 302 and connected to the center of the arcuate first and second supports 120, 130. The circular arc portion 332 has teeth 334 formed on the edge of the circular arc portion 332 away from the pivot 302. A gear 336 is attached to the shaft 308 of the motor 304. Teeth 338 of the gear mesh with the teeth 334 of the circular arc portion 332. In this embodiment, the motor reverses directions to move the gear 336 in directions J and K. When the gear 336 is moved in direction J, the first support 120 rotates about the pivot 302 in direction G (see FIGS. 7F-7H), and the second support 130 rotates about the pivot 302 in direction H (see FIGS. 7F-7H). When the gear 336 is moved in direction K, the second support 130 rotates about the pivot 302 in direction E (see FIGS. 7B-7D), and the first support 120 rotates about the pivot 302 in direction F (see FIGS. 7B-7D).

The movement of the figurine 200 will now be described with reference to FIGS. 7A-7I. FIG. 7A shows the moveable figurine assembly 100 in an initial position. For the purposes of illustration, the second support 130 is at its lowest position of travel in the initial position, and the figurine 200 is located at the end of the cord 140 proximate the end 132 of the second support 130. Direction A is angled downward in FIG. 7A.

Figure 7B:
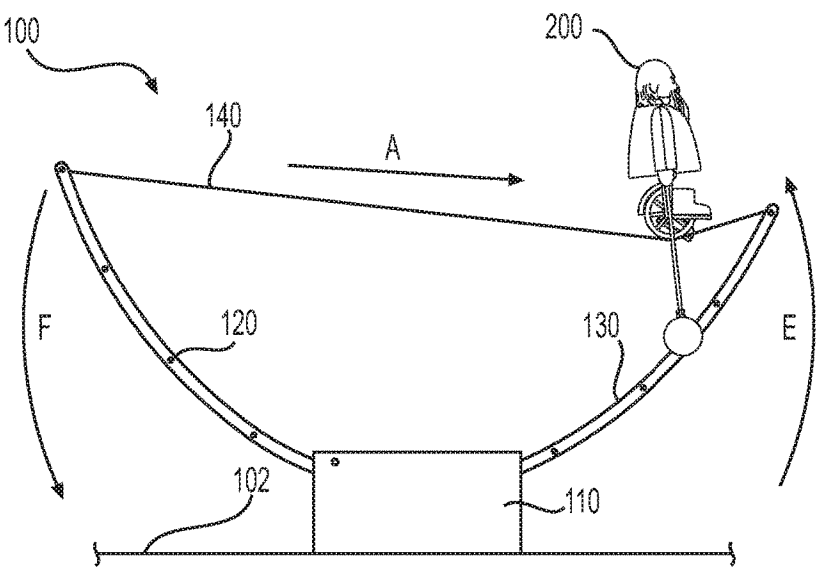
FIGS. 7A-7I are side views of the moveable figurine assembly shown in FIG. 1 showing movement of the figurine.
Figure 7A:
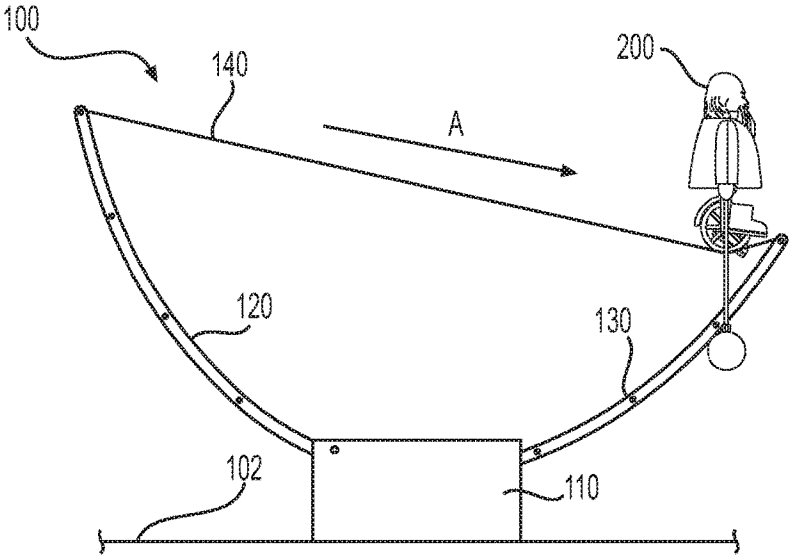
Figure 7C:
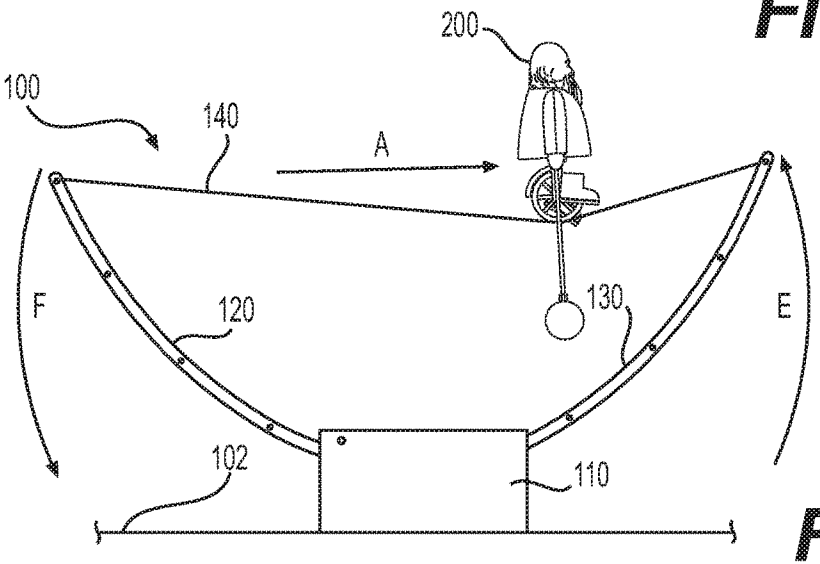

As shown in FIG. 7B, the movement mechanism 300 moves the end 132 of the second support 130 upward in a direction E. The attachment point 144 of the cord 140 to the second support 130 thus also moves in direction E. The movement mechanism 300 also moves the end 122 of the first support 120 downward in a direction F. The attachment point 142 of the cord 140 to the first support 120 thus also moves in direction F. As the attachment points 142, 144 of the cord 140 to each of the supports 120, 130 reach a position where they are generally horizontal from each other, the figurine 200 begins to move in the backward direction toward the center of the cord 140 above the base as shown in FIG. 7C.

Figure 7E:
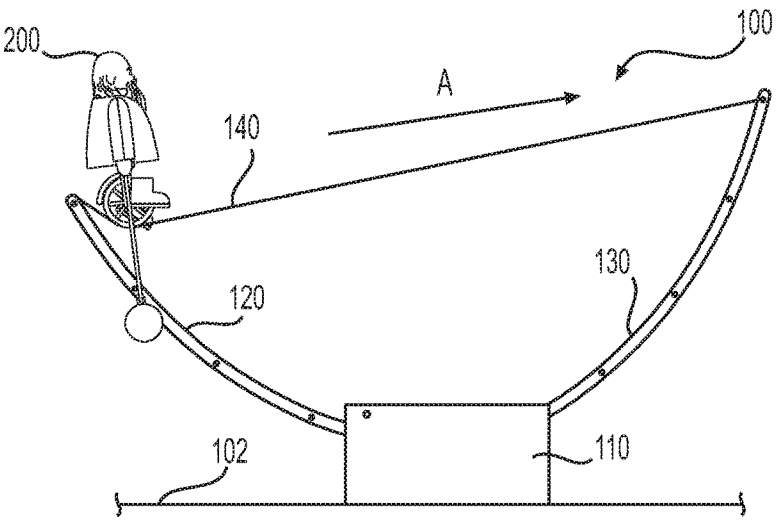
Figure 7D:
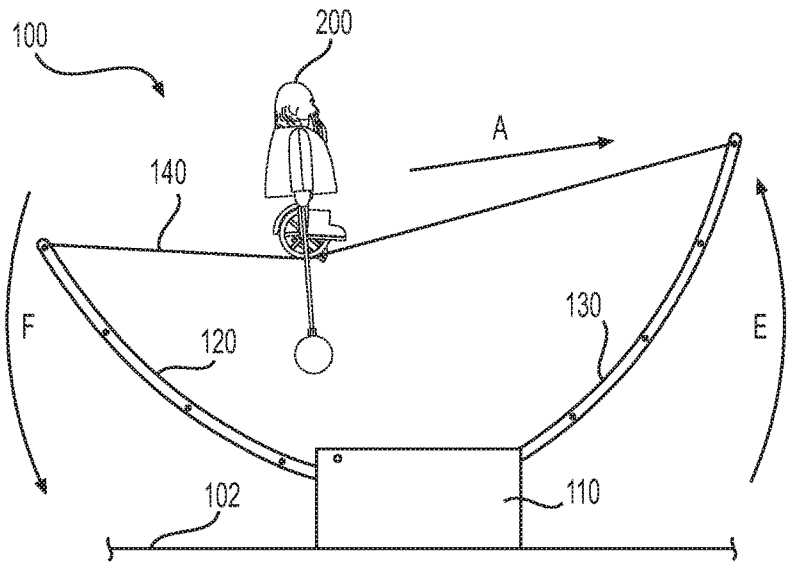

The movement mechanism 300 continues to move the supports in directions E and F such that direction A is angled upward as shown in FIG. 7D. With direction A angled upward, the figurine 200 continues to move in the backward direction until figurine 200 abuts the end 122 of the first support 120, as shown in FIG. 7E. The end 122 of the first support 120 thus acts as a stop to prevent further movement of the figurine 200. Although the figurine 200 may sway back and forth when figurine 200 contacts the end 122 of the first support 120, with the positioning of the center of gravity CG as discussed above, the figurine 200 does not fall backward off of the cord 140 or forward onto the cord 140. In FIG. 7E, the second support 130 is at its highest position of travel, and the first support 120 is at its lowest position of travel.

Figure 7F:
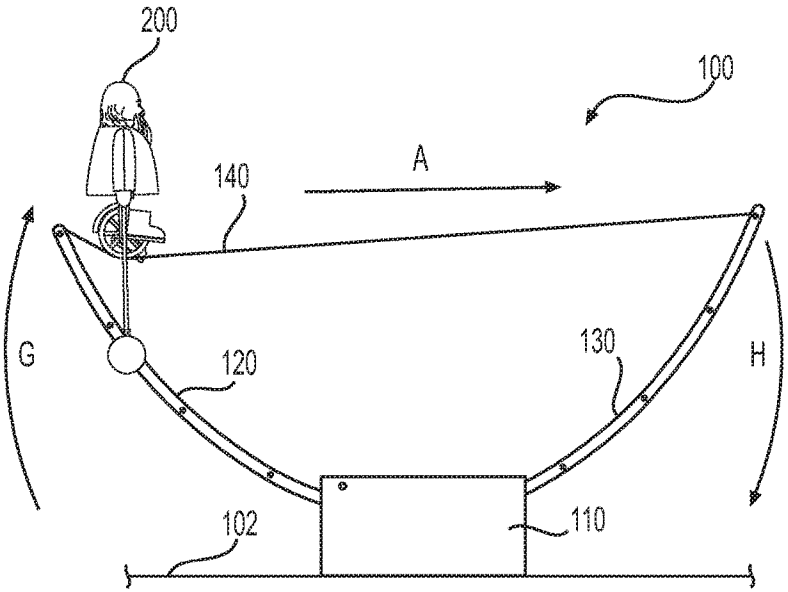

The movement mechanism 300 then moves the supports 120, 130 in the opposite direction. As shown in FIG. 7F, the movement mechanism 300 moves the end 122 of the first support 120 upward in a direction G. Direction G is a direction opposite to direction F. The attachment point 142 of the cord 140 to the first support 120 thus also moves in direction G. The movement mechanism 300 also moves the end 132 of the second support 130 downward in a direction H. The attachment point 144 of the cord 140 to the second support 130 thus also moves in direction H. As the attachment points 142, 144 of the cord 140 to each of the supports 120, 130 reach a position where they are generally horizontal from each other, the figurine 200 begins to move in the forward direction toward the center of the cord 140 above the base as shown in FIG. 7G.

Figure 7H:
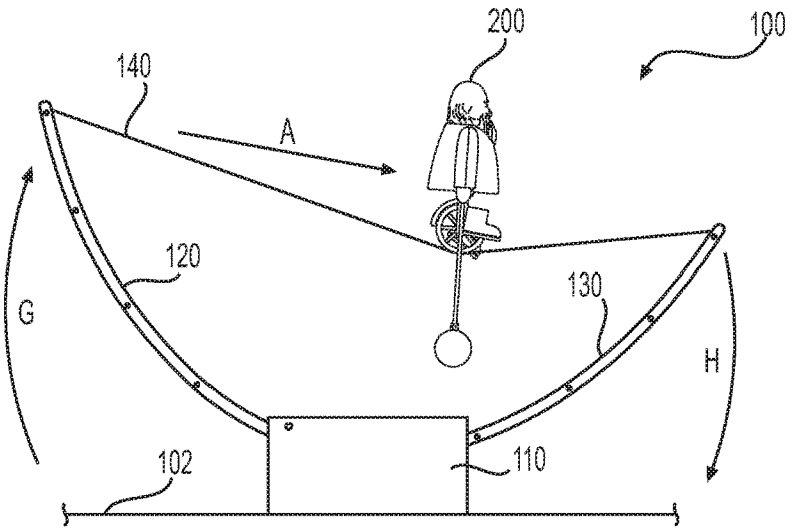
Figure 7G:
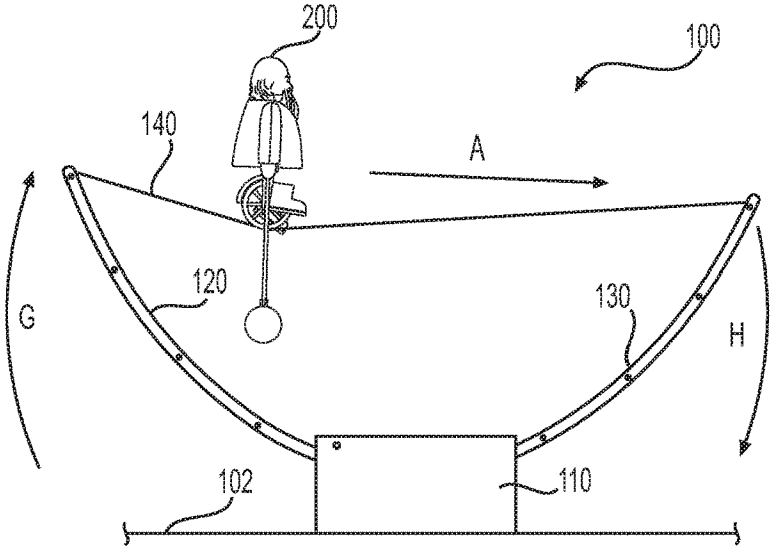
Figure 7I:
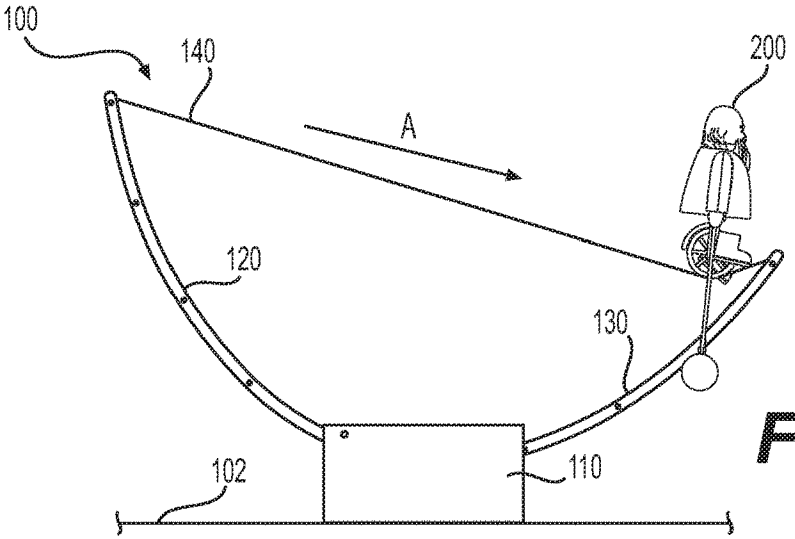

As with moving the figurine 200 in the backward direction, the movement mechanism 300 continues to move the supports in directions G and H such that direction A is angled downward as shown in FIG. 7H. With direction A angled downward, the figurine 200 continues to move in the forward direction until figurine 200 abuts the end 132 of the second support 130, as shown in FIG. 7I. As with the end 122 of the first support 120, the end 132 of the second support 130 thus acts as a stop to prevent further movement of the figurine 200. The moveable figurine assembly 100 as shown in FIG. 7I is in the same configuration as the initial position shown in FIG. 7A. Thus the sequence can be repeated and the movable figurine 200 moves back and forth on the cord 140 as the supports 120, 130 are oscillated through their various positions.

Although this invention has been described in certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A moveable figurine assembly comprising:

a base;

a moveable support supported by the base, the support extending upward from the base and having a transverse portion and a pair of stops at each end of the transverse portion;

a figurine balanced on the transverse portion of the moveable support, the figurine including:

a wheel;

a body positioned above the wheel and connected to the wheel; and a pair of extensions, each extension having a first end attached to the body and a second end; and a movement mechanism configured to oscillate the support between different angles of inclination such that the transverse portion of the support is inclined at an angle relative to horizontal, and when the direction is inclined at a downward angle, the figurine moves on the support in a downward direction, each of the stops being configured to stop the movement in a downward direction of the figurine, the different angles of inclination being such that the figurine moves in both a forward and backward direction on the support as the movement mechanism oscillates the support.

2. The moveable figurine assembly of claim 1, wherein the movement mechanism is a motor.

3. The moveable figurine assembly of claim 1, wherein the transverse portion is a cord (i) attached, at an attachment point, to opposite ends of the portion of the support extending upward from the base and (ii) spanning a distance between the opposite ends of the support.

4. The moveable figurine assembly of claim 1, wherein the transverse portion of the support is at least one of a rail, a rod, and a beam.

5. The moveable figurine assembly of claim 1, wherein the figurine has a center of gravity, the center of gravity of the figurine being at a level of the transverse portion of the support or below.

6. The moveable figurine assembly of claim 1, wherein the second end of each extension of the pair of extensions is positioned below the transverse portion of the support.

7. The moveable figurine assembly of claim 1, further comprising a mass located on the second end of each of extension.

8. The moveable figurine assembly of claim 1, wherein the portion of the support extending upward from the base has an arcuate shape.

9. A moveable figurine assembly comprising:

a base;

a pair of moveable supports including a first support and a second support, each of the supports extending upward from the base, such that the second support is spaced apart from the first support in a first direction;

a cord (i) attached to each of the first and second supports at an attachment point and (ii) spanning a distance between the first support and the second support;

a figurine balanced on the cord, the figurine including:

a wheel having an outer circumference with a groove therein, a bottom portion of the wheel contacting the cord and a portion of the cord being within the groove;

a body positioned above the wheel and connected to the wheel; and a pair of extensions, one extension being located on one side of the wheel relative to a plane in which the first direction lies and the other extension being located on the other side of the wheel relative to the plane in which the first direction lies, each extension of the pair of extensions having a mass located thereon; and a movement mechanism is configured to move the first and second supports to incline the first direction relative to horizontal such that the figurine (i) moves in the first direction when the first direction is inclined at a downward angle and (ii) moves in a direction opposite to the first direction when the first direction is inclined at an upward angle.

10. The moveable figurine assembly of claim 9, wherein the figurine has a center of gravity, the center of gravity of the figurine being below the cord.

11. The moveable figurine assembly of claim 10, wherein the center of gravity of the figurine is located in the plane in which the first direction lies.

12. The moveable figurine assembly of claim 9, wherein each extension of the pair of extensions extends from a portion of the figurine above the cord to a position below the cord.

13. The moveable figurine assembly of claim 12, wherein the mass is located below the cord.

14. The moveable figurine assembly of claim 9, further comprising an electric motor configured to move the first and second supports.

15. The moveable figurine assembly of claim 9, wherein the cord has a length, the length of the cord being longer than the distance between the first support and the second support.

16. A moveable main body assembly comprising:

a first support having an end;

a second support spaced apart from the first support by a distance in a first direction, the second support being moveable and having an end;

a transverse support (i) attached to each of the first and second supports at an attachment point and (ii) spanning the distance between the first support and the second support, the attachment point being a distance lower than the corresponding end of the first and second support to form a first stop and a second stop, respectively;

a wheel, a bottom portion of the wheel contacting the transverse support;

a main body connected to the wheel and being configured to oscillate in the first direction and a second direction on the transverse support when the second support is moved, such that the main body (i) moves in the first direction when the attachment point of the transverse support to the second support is lowered and (ii) moves in the second direction when the attachment point of the transverse support to the second support is raised, the second direction being a direction opposite to the first direction; and a pair of extensions, one extension of the pair of extensions being located on one side of the wheel relative to a plane in which the first direction lies and the other extension of the pair of extensions being located on the other side of the wheel relative to the plane in which the first direction lies, each extension of the pair of extensions having a mass located thereon.

17. The moveable main body assembly of claim 16, wherein the main body, the wheel and the pair of extensions have a combined center of gravity, the combined center of gravity being at a level of the transverse support or below.

18. The moveable main body assembly of claim 16, wherein each extension of the pair of extensions is connected to the main body and extends downward from the main body to a position below the transverse support.

19. The moveable main body assembly of claim 18, wherein the mass is located below the transverse support.

20. The moveable main body assembly of claim 16, wherein the transverse support is at least one of a cord, a rail, a rod, and a beam.

* * * * *